US006652426B2

(12) United States Patent
Carter et al.

(10) Patent No.: US 6,652,426 B2
(45) Date of Patent: Nov. 25, 2003

(54) EXERCISE MACHINE

(76) Inventors: Clayton R. Carter, 1049 E. 2100 North, North Logan, UT (US) 84341; Flint Hamblin, 1355 N. 800 East, #6-C, Logan, UT (US) 84341; R. Scott Galbraith, 2960 Naomi Dr., North Logan, UT (US) 84341

( * ) Notice: Subject to any disclaimer, the term of this patent is extended or adjusted under 35 U.S.C. 154(b) by 155 days.

(21) Appl. No.: 10/007,771

(22) Filed: Nov. 8, 2001

(65) Prior Publication Data

US 2003/0087736 A1 May 8, 2003

(51) Int. Cl.[7] ..... A63B 21/062
(52) U.S. Cl. ..... 482/100
(58) Field of Search ..... 48/97, 135, 62, 48/136, 134, 99, 100

(56) References Cited

U.S. PATENT DOCUMENTS

| | | | | |
|---|---|---|---|---|
| 4,183,520 | A | | 1/1980 | Chase |
| 4,795,147 | A | | 1/1989 | Seal |
| 4,880,227 | A | | 11/1989 | Sowell |
| 4,921,242 | A | | 5/1990 | Watterson |
| 4,988,095 | A | | 1/1991 | Ferrari |
| 5,000,442 | A | * | 3/1991 | Dalebout et al. |
| 5,316,534 | A | | 5/1994 | Dalebout et al. |
| 5,336,150 | A | | 8/1994 | Mueller et al. |
| 5,487,714 | A | | 1/1996 | Ferrari |
| 5,554,085 | A | | 9/1996 | Dalebout |
| 5,692,997 | A | | 12/1997 | Stearns |
| 5,800,321 | A | | 9/1998 | Webber |
| 5,938,575 | A | | 8/1999 | Stearns |
| 5,957,817 | A | | 9/1999 | Koenig et al. |
| 5,967,954 | A | * | 10/1999 | Habing |
| 6,071,216 | A | | 6/2000 | Giannelli et al. |
| 6,090,020 | A | | 7/2000 | Webber |
| 6,102,836 | A | * | 8/2000 | Person |
| 6,120,419 | A | | 9/2000 | Huang |

* cited by examiner

*Primary Examiner*—Jerome W. Donnelly
(74) *Attorney, Agent, or Firm*—Holme Roberts & Owen LLP

(57) ABSTRACT

An exercise machine has a base with an upright member secured thereto. A pair of lever arms are rotatably positioned on the upright member and rotate from a first position to a second position. A gas cylinder assembly is mechanically associated with the upright member and connected to the lever arms by a chain means. The gas cylinder assembly provides resistance to movement of the lever arms from the first toward the second position. A purchase assembly is mechanically associated with the frame and connected to the lever arms by a cable means. The purchase assembly includes a block and tackle to provide a mechanical advantage for moving the lever arms from the first position toward the second position. A line from the block and tackle is connected to one of several possible moveable elements such that operation of the moveable element results in movement of the lever arms.

19 Claims, 16 Drawing Sheets

EXERCISE MACHINE

BACKGROUND OF THE INVENTION

1. Field of the Invention

The present invention relates to exercise machines and, more particularly, to multi-functional exercise machines having an upright member with resistance structure mechanically associated with said upright member.

2. State of the Art

Anaerobic exercise machines are generally intended to exercise certain muscle groups of the body of a user by moving those muscle groups in specific ways through select ranges of motion. The muscle groups typically work against a resistance as they move through a desired range of motion. The resistance may be provided through free weights, such as dumbbells and barbells. Other forms of resistance means may also be used, such as friction pads, springs, flexible bands and hydraulic cylinders.

For example, U.S. Pat. No. 4,346,888 (Szabo) discloses a weight-lifting device having a central weight stack interconnected by a cable and pulley system to a carriage disposed about an upright member with wheels to be moveable along the upright member. The device may be operated or reconfigured using the same carriage to provide for different exercises by the user. U.S. Pat. No. 4,492,375 (Connelly) also shows a machine with a carriage moveable along an upright member to provide for different exercises at different locations along the vertical member. Rather than employ a weight stack to provide the resistance, however, the '375 patent shows a device with endless elastic bands or torsional springs to provide variable resistance to pivoting of a lever arm.

Other exercise machines employ an arm or lever that can be reconfigured to provide for different exercises. For example, U.S. Pat. No. 4,763,897 (Yakata) shows an exercise machine with a single weight and cable arrangement interconnected to a lever that may be reoriented in relation to a platform to provide for a variety of different exercises. Similarly, U.S. Pat. No. 4,898,381 (Gordon) shows an exercise machine with weight stacks interconnected by pulleys to a variety of levers that may be reconfigured for performing different exercises.

Multi-station exercise machines also exist. For example, U.S. Pat. No. 5,316,534 (Dalebout et al.) discloses an exercise machine having a plurality of stations each having an operating device for performance of exercise by a user. The operating device of each station is connected by a cable to a connection system which is further connected to a single resistance mechanism. U.S. Pat. No. 4,316,609 (Silberman) also discloses an exercise apparatus that enables a user to perform a wide variety of weight training exercises. The apparatus includes a basic bench with a barbell cradle, a rope and pulley weight-pull device, and other readily attachable devices for performing curling, sit-ups and leg lifts.

U.S. Pat. No. 4,390,179 (Szkalak) discloses a multi-functional exercise machine that includes a structural framework having a number of positions for the stationing of different types of exercising machines. Each of the different types of exercise machines employs a pulley system to lift a variable weight, and the pulley systems themselves each share a common central pulley that is pivotally attached to the framework and guides a cable to the variable weight.

A challenge often faced by the designers of exercise equipment is how to design a mechanically uncomplicated multifunction exercise machine that is capable of delivering preferred resistance profiles associated with preferred exercises. The exercise machines previously identified tend to be complicated mechanically, difficult to assemble and operate, or difficult to maintain. Alternatively, the machines may be less complicated, but at the expense of not providing a sufficient variety or selection of exercises that can be repeatedly selected by the user to provide for a regular, repetitive program of exercise that covers the various muscle groups using a preferred resistance profile. The present invention addresses these drawbacks.

SUMMARY OF THE INVENTION

An exercise machine has a frame that includes a support structure for positioning on a support surface and an upright member. The machine includes a pair of lever arms that are pivotally mounted to the upright member and that rotate, independently of one another, between first and second positions.

A resistance structure provides resistance to rotation of the lever arms. The resistance structure includes a pair of gas cylinder assemblies that are connected to an interior portion of the upright member. The gas cylinders have telescoping piston rods extending axially therefrom. The distal ends of the gas cylinders are connected by chains to the lever arms in such a way that each of the lever arms may rotate independently from the other.

A purchase structure provides a mechanical advantage when rotating the lever arms. The purchase structure includes a pair of block and tackle assemblies. A first block of each block and tackle assembly is connected to a respective lever arm through independent linking means. A second block of each block and tackle assembly is connected to the frame. A line interconnects the first and second blocks of each block and tackle assembly. A distal end of the line extends away from one of the first block and the second block of each assembly and connects to a moveable element.

The exercise machine includes a first and second plurality of apertures spaced along the length of each of the lever arms. The first plurality of apertures permits selective positioning of the linking means between the purchase structure and each lever arm. The second plurality of apertures permits selective positioning of the linking means between the resistance structure and each lever arm. Selective positioning of the resistance linking means permits a variety of resistance profiles to be achieved. Selective positioning of the purchase linking means permits a variety of mechanical advantage profiles to be achieved. Spacing the first plurality of apertures along an elliptical path and connecting the second block and one end of the purchase linking means at the focal points defined by the elliptical path permits adjustment of the purchase means without the need for adjusting the distance between the first and second blocks.

The moveable element assumes a variety of configurations. For instance, the moveable element includes a lat pull-down element or a leg-curl element, such that lat-pulls or leg-curls may be performed. Alternatively, the moveable element includes of a pair of hand-held units, such that rowing-type, bench-press or biceps-curl exercises may be performed. An adjustable seat means is disposed on a bench to allow reconfiguration of the exercise machine to permit a variety of exercises.

BRIEF DESCRIPTION OF THE DRAWINGS

In the drawings, which illustrate what is presently regarded as the preferred embodiment.

DETAILED DESCRIPTION OF THE INVENTION

Figure 1:
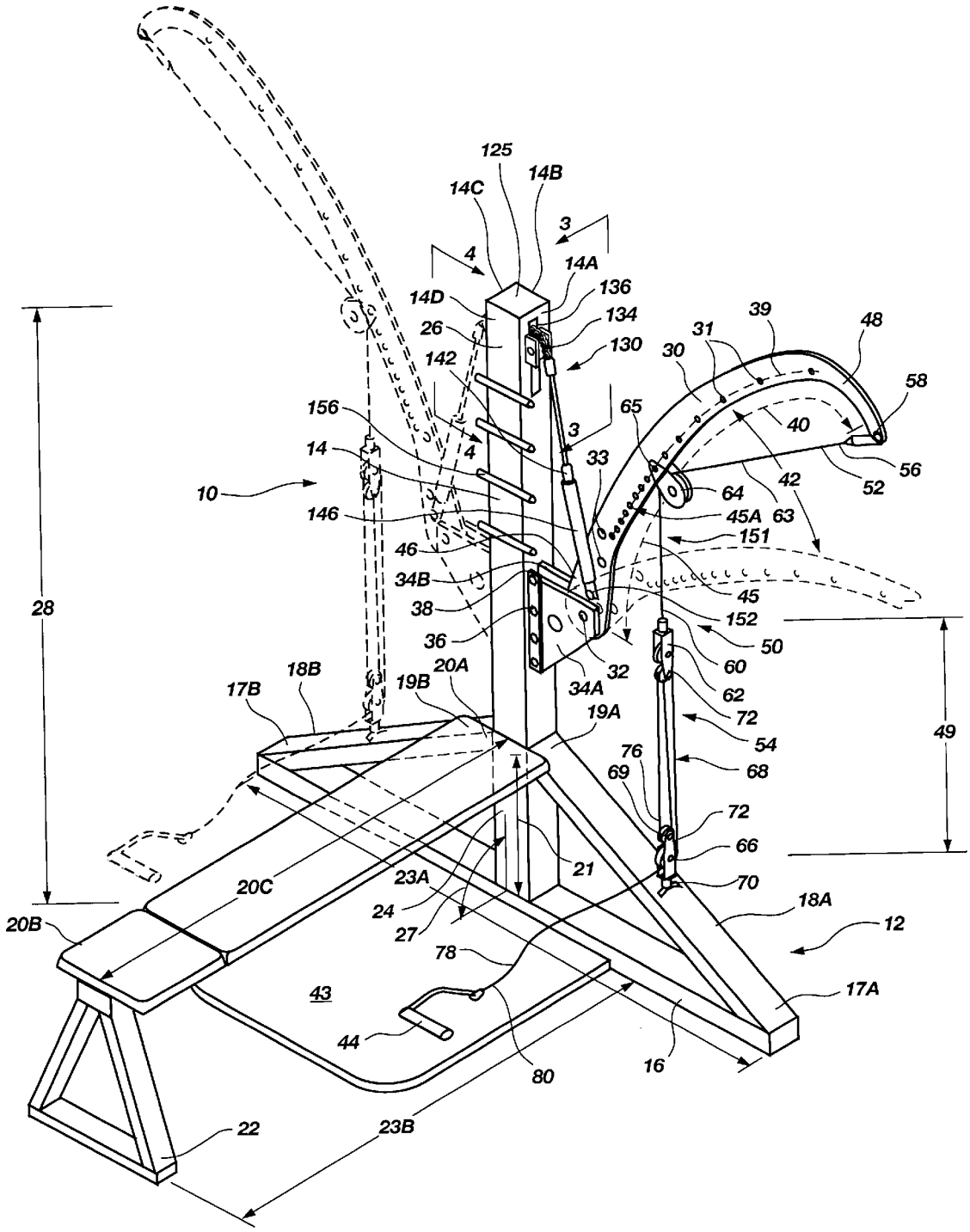
FIG. 1 is a perspective view of a preferred embodiment of the exercise machine of the present invention.

A perspective view of an exercise machine 10 for performing various rowing-type and weight training-type exercises is depicted in FIG. 1. The exercise machine 10 is used to perform aerobic exercises (e.g., rowing) and anaerobic exercises (e.g., pulls and curls).

(Frame) The exercise machine 10 has a frame 12 that includes an upright member 14 and support means that include a base member 16 for positioning on a support surface and a pair of buttress support members 18A and 18B. The buttress support members 18A and 18B are connected at one end 17A and 17B to the base member 16 and at the other end 19A and 19B to the upright member 14. A height 21, for attaching the buttress support members 18A and 18B to the upright member 14, is selected to provide suitable support for the upright member 14. For example, the height 21 is from about 10 inches to about 20 inches for an upright member that is about five feet in length 28. All such connections are made using welds or nuts and bolts.

The frame 12 further includes a user support means that is shown here as bench 20. The bench 20 is attached at one end 20A to the upright member 14. The bench 20 extends away from the upright member 14 a distance 20C that is selected to accommodate an adult male on his back (e.g., the distance 20C is from about 30 inches to about 60 inches). Although the bench 20 is preferably positioned normal to the upright member (or parallel to the support surface) the bench may, nonetheless, be positioned about 10 to 15 degrees in either direction of the normal direction.

A rear support structure 22 is positioned at the outer, or distal, end 20B of bench 20. The rear support structure 22 is connected to bench 20 and is configured to support a user on the bench 20. The bench 20 and the rear support structure 22 also function as part of the frame support means which, in combination with the base member 16, provide the exercise machine 10 with a footprint having a width 23A and length 23B. The footprint is sized (e.g., about 48 inches in width and about 48 inches in length) so that the exercise machine 10 is unlikely to tip over while in use. A footrest 43 is also secured to the base member 16 by any suitable means, such as by nuts and bolts, welding or the like.

It is noted that the base member 16, the buttress members 18, the bench 20 and the rear support structure 22 may assume a number of alternative configurations from that illustrated to provide sufficient structural support both for the upright member 14 and for a user in the performance of exercise when positioned on the bench 20 of the exercise machine 10. For example, a pair of base members may be positioned on the support surface in a cross-type arrangement with the upright member 14 secured at the center of the cross and extending upwardly therefrom (not shown).

(Upright member) The upright member 14 has a lower end 24 and an upper end 26. The upright member 14, as with the frame 12, is constructed of a suitable material or materials to withstand the stresses applied during operation of the exercise machine 10. In the preferred embodiment, a mild steel has been found suitable.

The upright member 14 is secured to the base member 16 and extends upright therefrom at a 90 degree angle 27. While the angle 27 is shown to be 90 degrees, it is within contemplation that the angle 27 may vary from about 75 degrees to about 105 degrees. Any suitable means are used to secure the upright member 14 to the base member 16, such as, for example, welding, bolting (with suitable brackets) or any other arrangement sufficient to secure one to the other.

With reference to FIG. 1, the upright member 14 has four sides 14A–D. The four sides 14A–D define an interior portion 25 disposed in the upright member 14 proximate the upper end 26. As discussed below, the interior portion 25 proximate the upper end 26 houses resistance means 90, which provides resistance during the performance of various exercises. The upright member 14 is shown in FIG. 1 to be square in cross section, but may also be of any other suitable shape in cross section, such as rectangular, circular or elliptical.

(Lever arms) The exercise machine of FIG. 1 further includes at least one and, preferably, a pair of lever arms, only one of which is shown (as lever arm 30) for ease of illustration. However, it should be understood that the other lever arm (i.e., the one not illustrated) is the same as lever arm 30, except for those differences that will be necessary to adapt it for use on the side opposite that shown.

The lever arm 30 is pivotally mounted to one of two opposing sides 14A and 14C (illustrated in FIG. 1 as side 14A) of the upright member 14 using pivot means disposed on support means. The pivot means is any suitable bolt, axle, pin or the like, made of suitably strong material to withstand the applied forces. The support means is any suitable structure attached to the upright member 14 to rotatably attach the lever arm 30 thereto. By way of example, the support means includes a pair of plates, like plates 34A and 34B, connected to each of opposing sides 14A and 14C of upright member 14. Similarly, the pivot means includes a pivot shaft 32 or bolt that extends through a hole drilled in each of the plates 34A and 34B. A corresponding hole, of course, is drilled through the first end 46 of the lever arm 30 to accommodate the pivot shaft 32.

As further illustrated in FIG. 1, the support plates 34A and 34B are secured to the upright member 14 by any suitable means, such as by bolts 36 that extend through a securing tab 38. The securing tab 38 is secured to the upright member 14 by welding. It is noted that the support plates 34A and 34B may, alternatively, be secured to the upright member 14 by any other suitable means, such as by welding directly to the upright member 14. Alternatively, the lever arm 30 may be pivotally mounted directly to the upright member 14 by mounting the pivot shaft 32 directly to upright member 14 (e.g., by welding), thus eliminating the need for the support plates 34A and 34B. This latter alternative, however, will likely require apertures to be positioned in the upright member 14, proximate the positioning of the pivot shaft 32, so as to accommodate the first end 46 of the lever arm 30.

The lever arm 30 has a first end 46 and a second end 48 spaced from the first end 46. The lever arm 30 is preferably arcuate in shape, rather than straight, and has a length 45 (measured along the dashed line as illustrated) of about 30 to about 50 inches. The lever arm 30 further has a first and second plurality of spaced apart apertures, 31 and 32, respectively, disposed along its length. As discussed below, the apertures permit selective positioning of structure that links, separately, resistance means and purchase means to the lever arm 30. More particularly, and as described below, the resistance means 90 is linked to one of the second plurality of apertures 33 using receiving bracket 146, which includes a pin means 152 for connection with one of the apertures 33. Similarly, the purchase means 50 is linked to one of the first plurality of apertures 31 through pulley assembly 64, which includes a pin means 65 for connection with one of the apertures 31.

In a preferred embodiment of the exercise machine, the first plurality of spaced apart apertures 31 is positioned along an essentially elliptical path 39 as shown. That is, the lever arm 30 and, more particularly, the arc defined by length 45, is essentially elliptical in shape, from about the midpoint 45A to about the second end 48. Positioning the apertures 31 along the elliptical path 39, as explained further below, permits the distance 49 between the blocks 62, 66 of a block and tackle assembly to remain essentially constant when repositioning the pulley assembly 64 along the lever arm 30.

(Purchase means) The lever arm 30 is configured, as illustrated, to rotate from a first position 40 toward a second position 42. Rotation of the lever arm 30 from its first position 40 toward its second position 42 is accomplished using a purchase means 50 which, itself, is connected to lever arm 30 using a linking means. In the description that follows, only a single purchase means is illustrated, which is consistent with the description of the exercise machine above wherein only a single lever arm is illustrated.

Figure 17A:
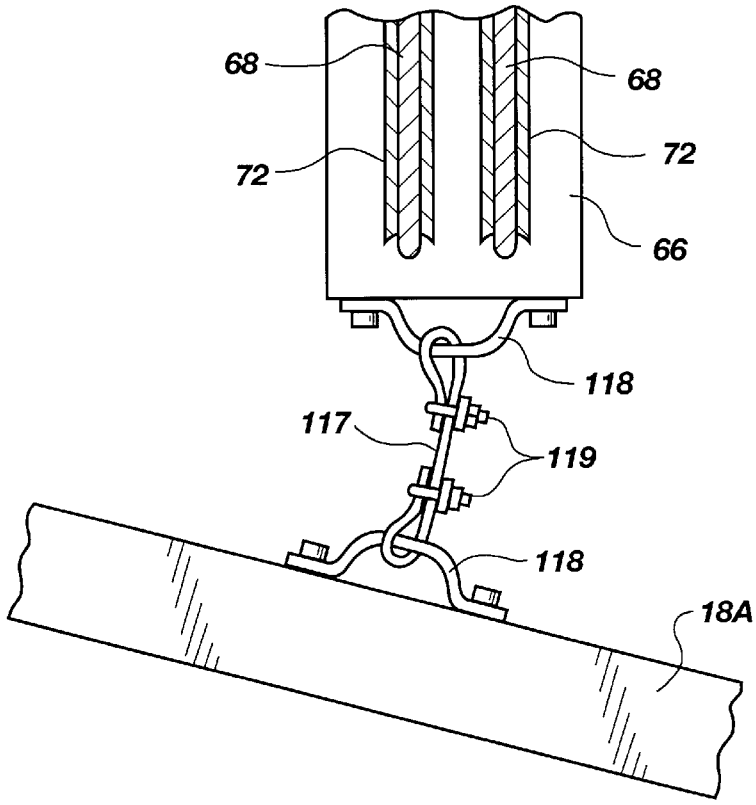
FIG. 17A is a view of a block from a block and tackle assembly secured to the frame using a cable looped about a pair of clips and secured using a pair of U-bolt clamps.

(Block and Tackle) A preferred embodiment of the purchase means 50 includes a block and tackle 54. Block and tackle 54 has a first block 62 and a second block 66. The first block 62 and the second block 66 are interconnected by a line 68 reeved about the pulleys of blocks 62 and 66 to obtain a mechanical advantage. A preferred arrangement has the first block 62 connected to the lever arm 30 using a linking means, such as, for example, cable 52 (discussed below). The second block 66 is connected to the buttress member 18 at a second connection point 70. The connection can be accomplished with a small piece of rope or cable. As shown in FIG. 17A, for example, the ends of a cable 117 are looped through clips 118 positioned on the frame and block and then secured using a suitable clamp, such as U-bolt clamps 119. Alternatively, the second block 66 may be connected directly to the buttress member 18; that is, without a rope or cable positioned there between.

Each of said first block 62 and said second block 66 have at least one pulley 72 mounted thereon using, for example, an axle or pin (not shown) extending through the respective block. As shown in FIG. 1, the block and tackle 54 employs a pair of pulleys 72 on both the first block 62 and the second block 66. It is noted here that depending on the degree of mechanical advantage that is desired, a lesser or greater number of pulleys 72 could be used with the blocks 62 and 66. The number of pulleys 72 will dictate the number of times that the line 68 is able to be looped between the blocks 62, 66 and, hence, the resultant mechanical advantage. Preferably, the number of pulleys 72 mounted on blocks 62 and 66 and the number of loops that line 68 makes between the blocks will provide a mechanical advantage from about 1.5 to about 5.

The line 68 is a cable (e.g., a wire) or a rope (e.g., nylon or manila) trained about the pulleys 72. As shown in FIG. 1, a first end 76 of the line 68 is connected to the second block. Any suitable means, such as a knot or a clamp (not shown), may be used to connect the first end 76 to the second block 66. Alternatively, the first end 76 may be connected to the first block 62. Regardless of which block the first end 76 is connected to, the line 68 is then trained or reeved about the pulleys 72, alternating between the first block 62 and the second block 66, in a conventional fashion, to provide the desired mechanical advantage. Finally, the second end 78 of the line 68 is led away from the second block 66 as the lead 80 for interconnection to a moveable element of the exercise machine 10. It is noted that although moveable element 44 appears in FIG. 1 as a handle, moveable element 44 is intended to include any type of moveable element that is configured for operation by a user, such as the leg curl element 200 and the lat pull element 266 discussed below.

Figure 17B:
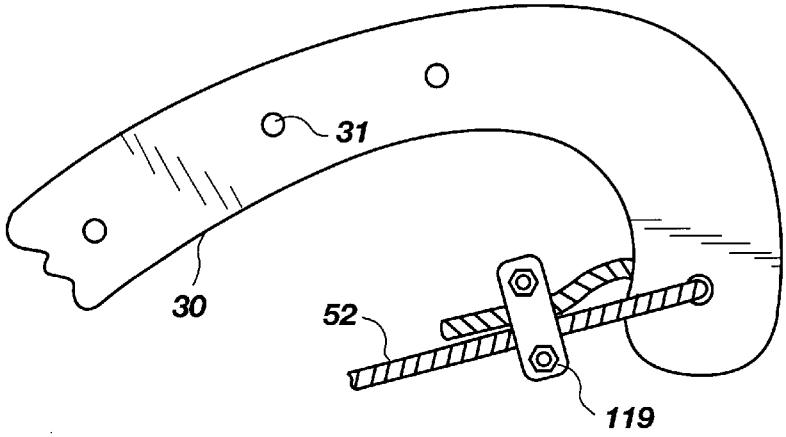
FIG. 17B is a view of a cable end secured to the lever arm by looping the end of the cable through a hole and securing the end using a U-bolt clamp.

(Purchase linking means) Disposed between lever arm 30 and block and tackle 54 are linking means 151. As best illustrated in FIG. 1, the linking means 151, for example, includes a cable 52 (e.g., a wire) operably associated with a guide means, which is here shown as a pulley assembly 64. The cable 52 has a first end 56 connected to the second end 48 of the lever arm 30 at a first connection point 58, a second end 60 connected to a first block 62 of block and tackle 54, and a bight 63 therein between. The ends of the cable 52 are connected to the second end 48 of lever arm 30 and to the first block 62 using any standard method, such as, for example, a knot. As shown in FIGS. 17A and 17B, stronger connections than those provided by a knot are achieved, for example, by looping the ends of the cable through holes or clips positioned on the block and lever arm and by securing the looped ends using a suitable clamp, such as a U-bolt clamp 119. Preferably, a pair of clamps 119 will be used for each connection, although only a single clamp is illustrated as making each connection in FIGS. 17A and 17B.

Figure 16A:
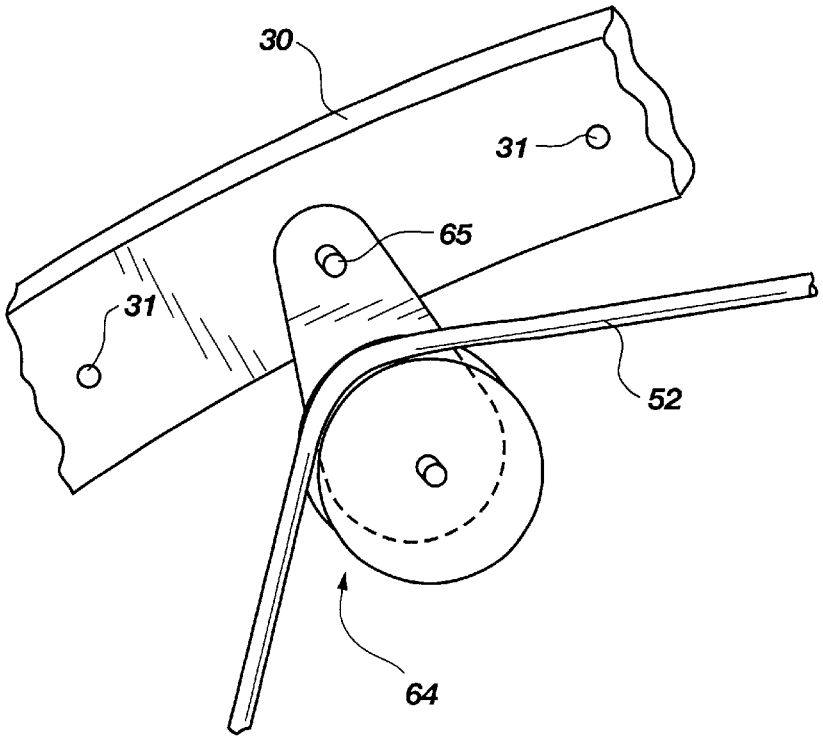
FIG. 16A is a view of the pulley assembly selectively positioned on the lever arm
Figure 16B:
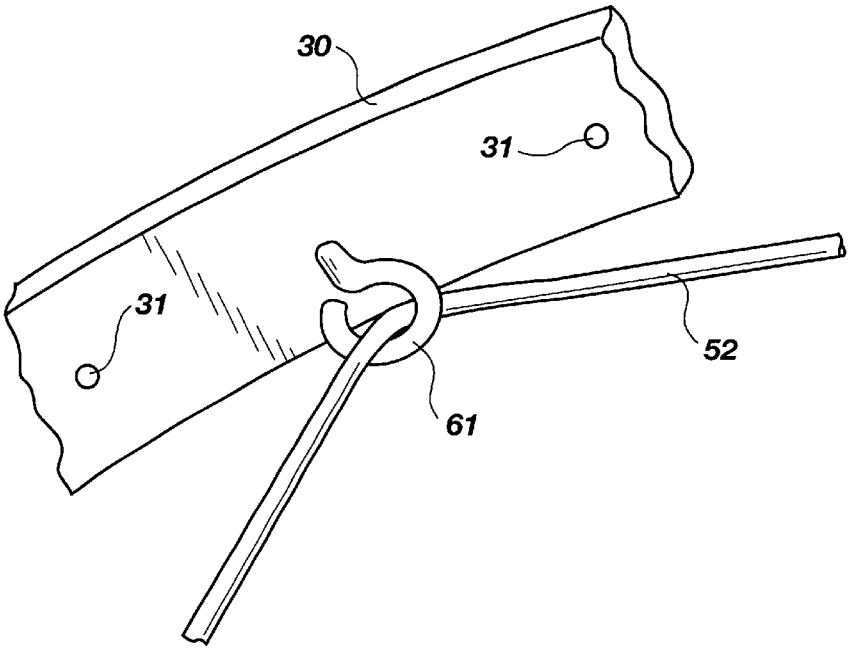
FIG. 16B is a view of the eye bolt assembly selectively positioned on the lever arm.

A guide means for directing the ends of the cable 52 to the second end 48 of the lever arm 30 and to the first block 62 is selectively connected to the lever arm 30 at one of said first plurality of spaced apart apertures 31. As is shown in FIG. 16A, for example, the guide means is a pulley assembly 64 with the cable 52 reeved about a portion of the pulley. The pulley assembly is connected to one of the first plurality of apertures 31 using a pin means 65, which can be a simple nut and bolt assembly or a similar shaft. The guide means may, alternatively, consist of any other structure whereby a cable may slidably pass. An example of this latter alternative might consist of a simple eye-bolt 61 secured to one of apertures 31, as shown in FIG. 16B.

An alternative arrangement (not shown) has the first end 56 connected directly to one of said first plurality of spaced apart apertures 31, thus eliminating the need for the guide means (e.g., the pulley assembly 64). For example, the first end 56 of the cable 52 could be connected directly to an eye-bolt, such as the eye-bolt 61 illustrated in FIG. 16B. The connection could be made by clamping the first end 56 to the eye-bolt 61 or by simply tying a knot to the eye-bolt. Another alternative embodiment (not shown) has the first block 62 connected directly to one of the first plurality of spaced apart apertures 31, thus eliminating the need both for the guide means and for the cable 52.

Figure 13:
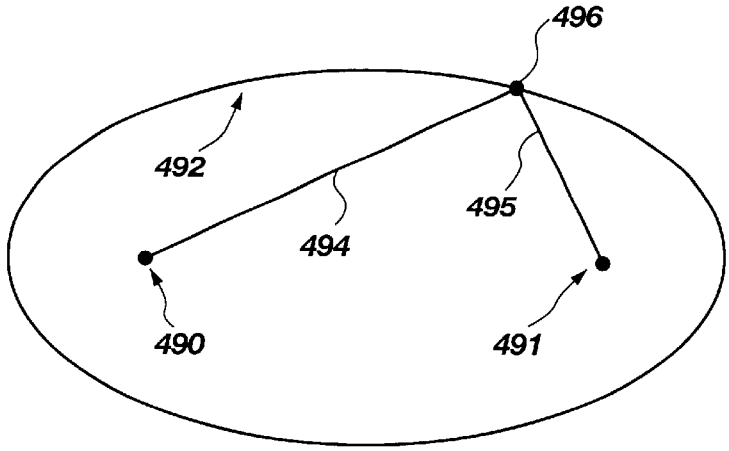
FIG. 13 is a view of an ellipse and its associated focal points.
Figure 14:
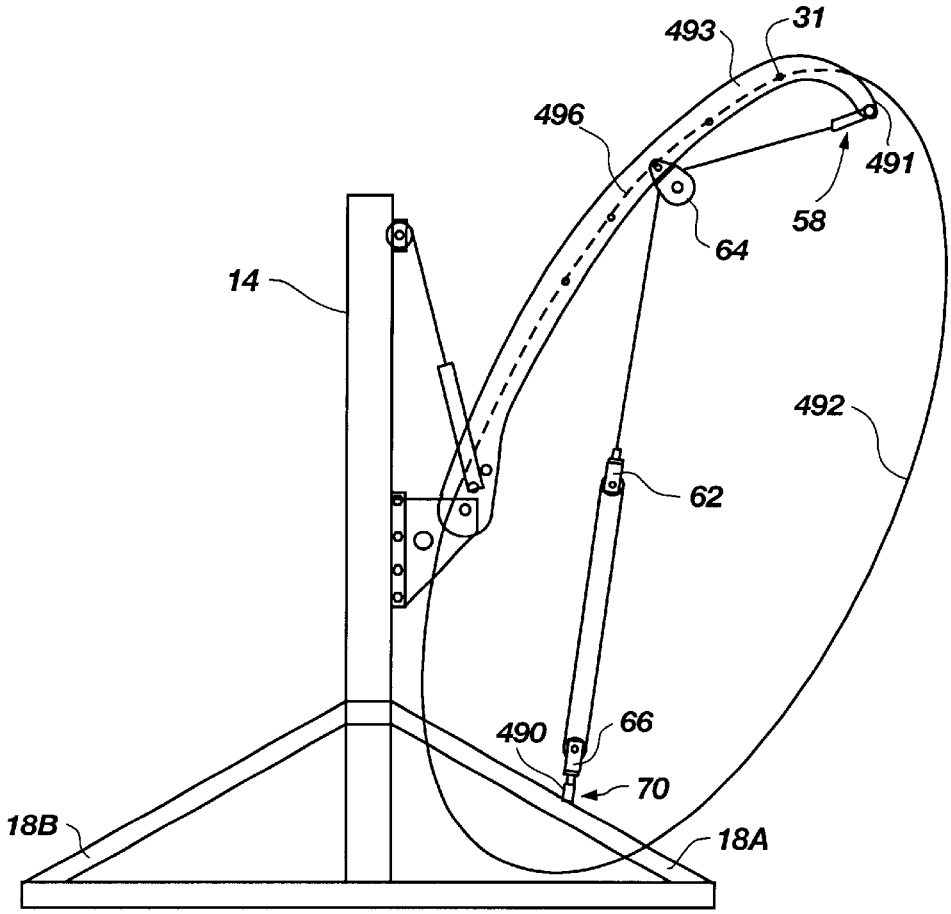
FIG. 14 is a frontal view of the exercise machine with the ellipse of FIG. 13 superimposed thereon.

(Ellipse explanation) As illustrated in FIGS. 13 and 14, the exercise machine has a first connection point 58 and second connection point 70 positioned at locations corresponding to the focal points 490, 491 of an ellipse 492 defined by an imaginary arc 493 (dashed line) drawn through apertures 31 when the lever arm 30 is in its first position 40. As is known, straight line segments 494, 495 that are drawn from the focal points 490, 491 defined by an ellipse 492 to a common point 496 on the ellipse sum to a constant length, irrespective of the location of the common point, so long as the common point lies on the ellipse 492. Thus, with the first and the second connection points, 58 and 70, so positioned, the pulley assembly 64 may be selectively positioned along the lever arm 30 without having to adjust the distance between the first block 62 and the second block 66. In turn, this arrangement allows a user to vary the force required to rotate the lever arm 30 (i.e., the force required to be applied to the moveable element 44) by selectively positioning the pulley assembly 64 along the lever arm 30 without having to adjust the distance between the first block 62 and the second block 66.

(Alternative to Purchase Means) Alternative embodiments to the purchase means 50, other than the block and tackle 54 described above, may be employed. For example, block and tackle 54 may be eliminated entirely, and replaced with a single line that runs from moveable element 44 to lever arm 30, with a guide means (e.g., a pulley) positioned in place of second block 66. This arrangement will, however, result in no mechanical advantage to movement of lever arm 30.

Alternatively, a reduction-gear-like assembly may be positioned on frame 10 and connected between lever arm 30 and moveable element 44 through, for example, suitable cable means. Still further, a rotatable arm and trolley mechanism, similar to that discussed in U.S. Pat. No. 5,554,085 (Dalebout), may also be positioned on frame 10 and connected between lever arm 30 and moveable element 44 in order to obtain the desired mechanical advantage.

(Resistance means) Referring now to FIGS. 1–4, the exercise machine of FIG. 1 further includes resistance means sized and configured to be disposed in the interior portion 25 of the upright member 14. Resistance means can be selected from a variety of assemblies, including, for example, gas cylinders, elastic elements, spring elements and weight stacks. Preferably, the resistance means will be disposed within the interior portion 25 of the upright member 14. Nonetheless, it should be appreciated that the resistance means may be disposed outside of the interior portion (as illustrated, for example, in FIG. 11) or partially within and without the interior portion (as illustrated, for example, in FIG. 12).

Figure 2:
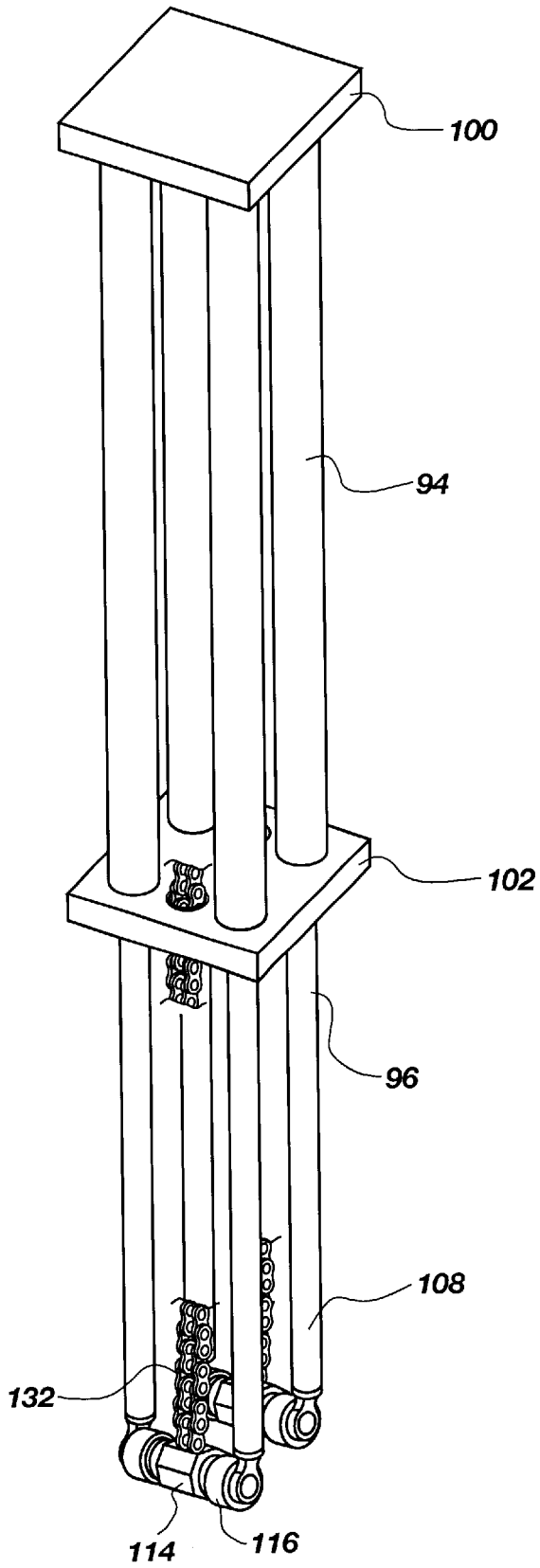
FIG. 2 is a perspective view of a gas cylinder arrangement used with the present invention.
Figure 3:
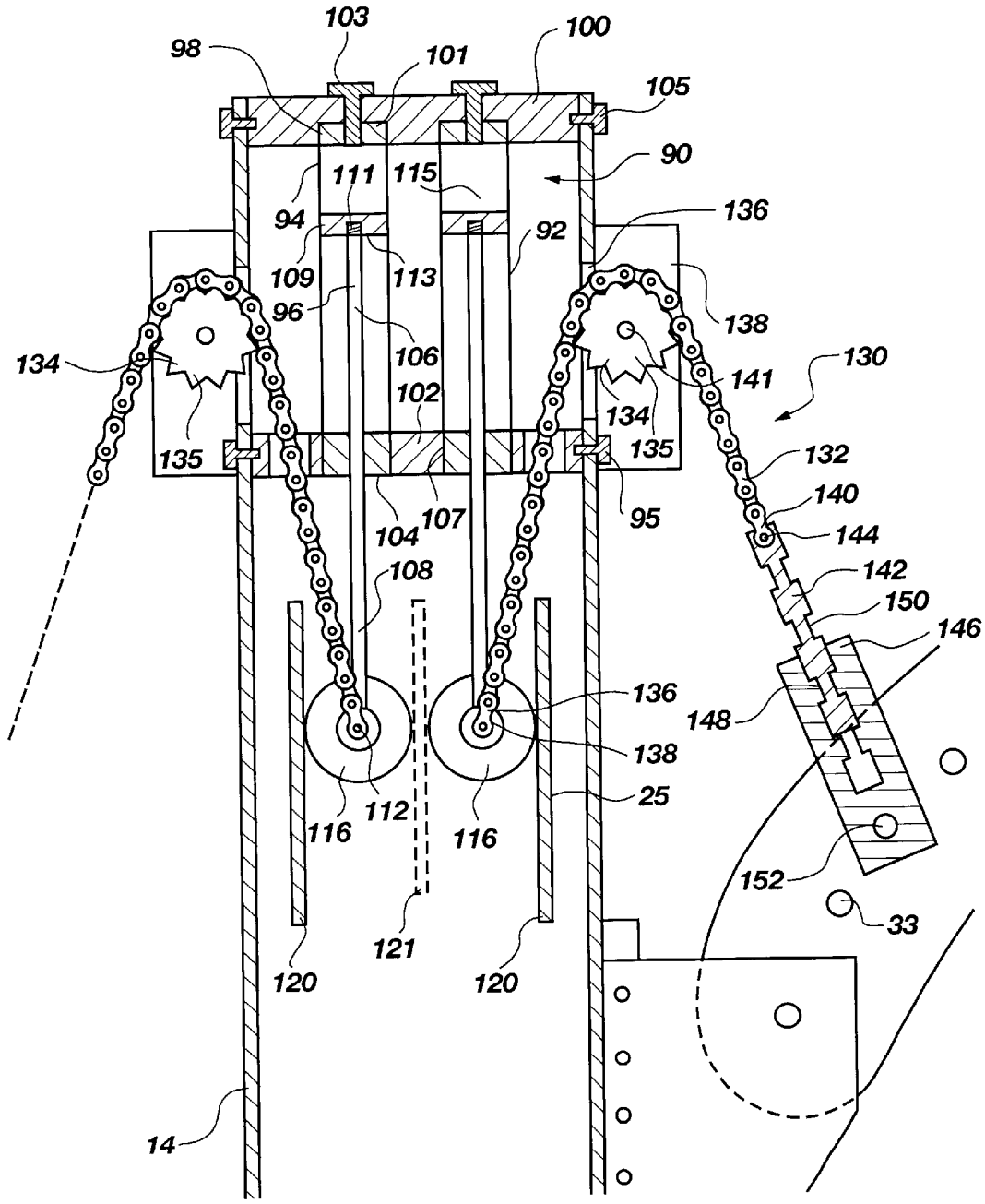
FIG. 3 is a frontal view of the gas cylinder arrangement taken along the line depicted in FIG. 1.
Figure 4:
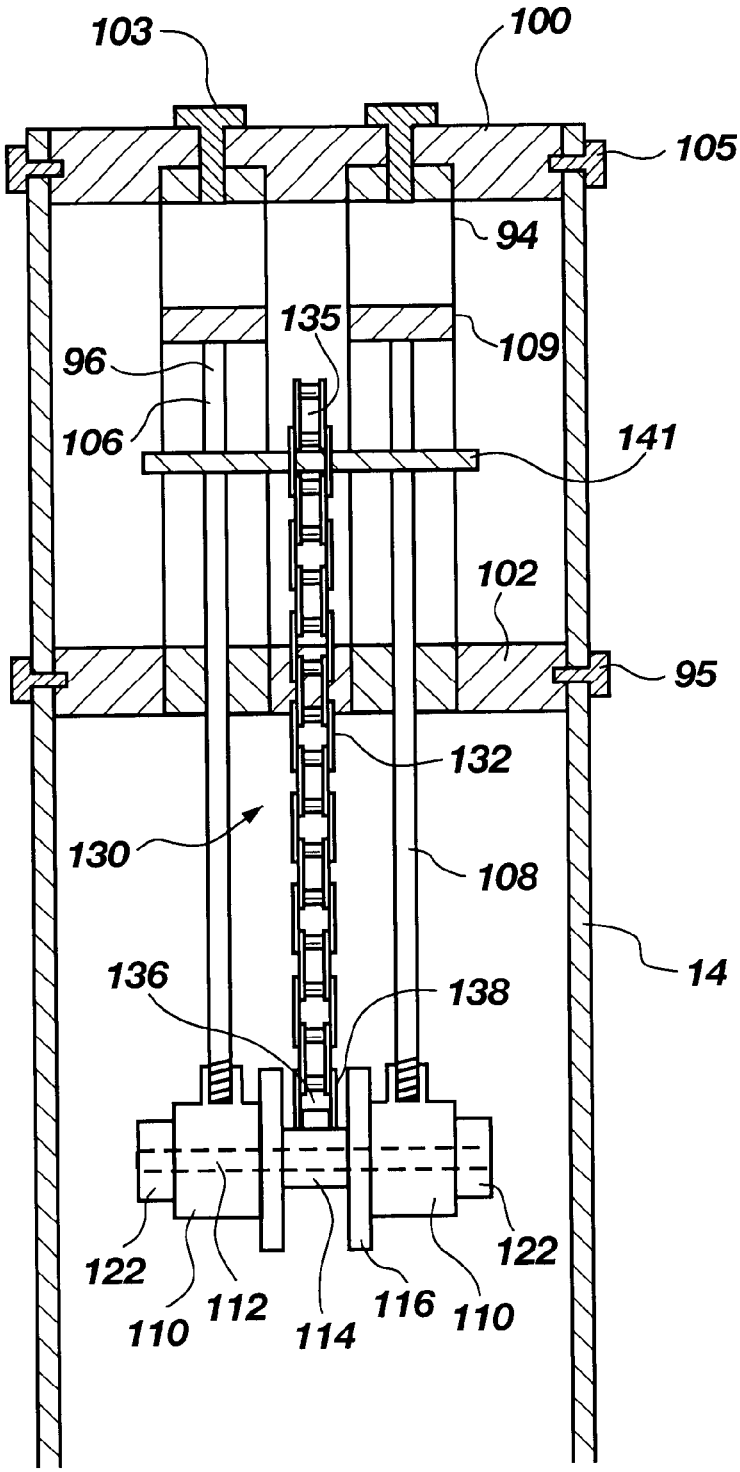
FIG. 4 is a side view of the gas cylinder arrangement taken along the line depicted in FIG. 1.

(Gas cylinders) Referring more particularly to FIGS. 2–4, a preferred embodiment of the resistance means includes a plurality of four gas cylinders 92 selectively arranged in a two-by-two format. Each of the gas cylinders 92 includes a generally elongate housing 94 with a telescoping piston rod 96 slidably communicating there within. The elongate housing 94 of each gas cylinder 92 includes a base portion 98 that is preferably secured within a recess 101 to a backing plate 100 by means of a set screw or bolt 103. The backing plate 100 is itself preferably secured to upright member 14 by means of a second set screw or bolt 105.

Figure 15:
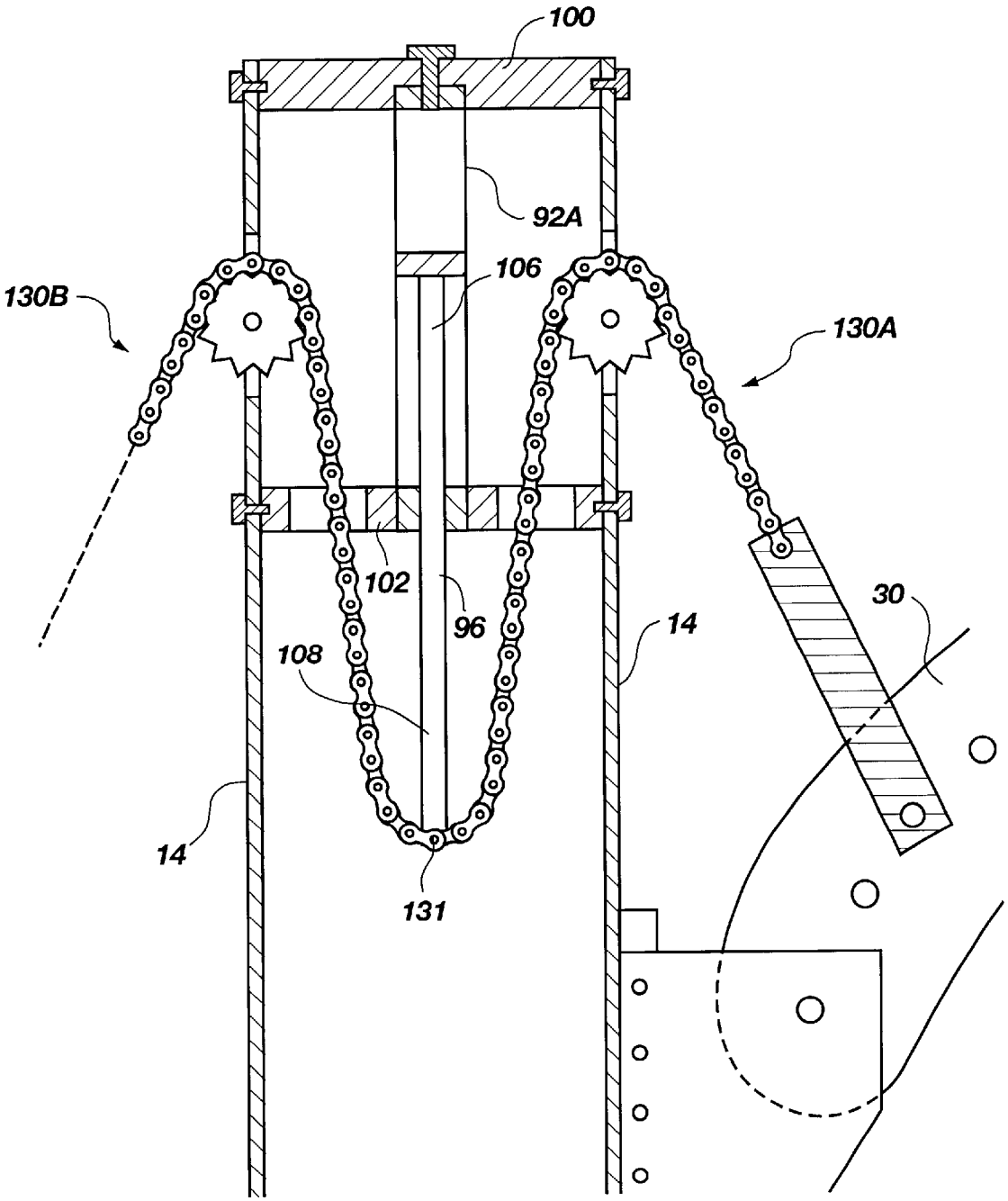
FIG. 15 is a view of a single gas cylinder arrangement and associated linking structure.

The use of multiple gas cylinders 92 permits each of the lever arms 30 to move independently from the other. This is accomplished through use of separate means to link each lever arm to its respective gas cylinder. Alternatively, and as illustrated in FIG. 15, it is noted that a single gas cylinder 92A may be employed instead of the multiple gas cylinder arrangement illustrated in FIGS. 2–4. A single gas cylinder arrangement, however, eliminates the ability of a pair of lever arms to move independently, one from the other, as both lever arms will be connected to the same gas cylinder. In FIG. 15, for example, a pair of linking means 130A and 130B, which correspond to a pair of lever arms (only lever arm 30 is illustrated), are shown to be connected at a common point 131 on the distal, or outer, end 108 of the piston rod 96.

(Stabilizing plate) A preferred embodiment of the exercise machine includes a stabilizing plate 102 with a plurality of four holes 107 bored at least part way there through to receive top portions 104 of each of elongate housings 94. The exact number of holes, however, will depend on the number of gas cylinders used. The stabilizing plate 102 is spaced a distance from the backing plate 100 and is secured to upright member 14 by set screw means 95 similar to those employed to secure backing plate 100. Alternatively, each top portion 104 may be press fit into the corresponding hole 107, thus obviating the need to employ set screws to secure stabilizing plate 102 to upright member 104. The stabilizing plate 102 secures each elongate housing 94 from lateral movement when a force is applied to the telescoping piston rods 96 by movement of the lever arm 30.

(Piston rod) Each piston rod 96 includes an inner portion 106 and an outer portion 108. The inner portion 106 extends telescopingly into elongate housing 94 and is preferably configured to receive a piston member 109. The piston member 109 is connected to the inner portion 106 by any suitable means, e.g., by threading a threaded portion 111 of the piston member 109 onto a corresponding threaded portion 113 of inner portion 106. Suitable sealing means may be disposed, if necessary, between the wall of piston member 109 and the gas cylinder wall to prevent the leaking of gas 115 from within to without the cylinder. It is noted here that gas cylinders of the type herein discussed are known, such as, for example, those used in connection with U.S. Pat. No. 5,316,534 (Dalebout et al.).

(Sleeve components) Referring now to FIG. 4, there is secured to each outer portion 108 of the piston rods 96 a sleeve 110 for mechanical association with a pin means 112 (shown in phantom). The sleeve 110 is secured to the outer portion 108 using any conventional means, such as, for example, by threading as discussed previously with regard to piston member 109. As further illustrated in FIG. 4, each of pin means 112 is slidably disposed through sleeves 110. Proximate the center portion of each pin means 112 is disposed a second sleeve member 114. The second sleeve member 114 is positioned in between a pair of roller members 116, which are also slidably disposed on the pin means 112. Roller members 116 are preferably sized to make rolling contact with a guide plate 120 (see FIG. 3), where the guide plate(s) 120 is secured to the upright member 14 by any suitable means. Alternatively, or in conjunction therewith, a single guide plate 121 (shown in phantom) is disposed between roller members 116. Regardless of the exact configuration, the guide plates 120, 121 are positioned to minimize the lateral forces that are imposed on piston rods 96. If such lateral forces are minor, for example, in relation to the lateral force required to bend the piston rod 96, then use of guide the plates 120, 121 will not be necessary. Finally, end caps 122 are secured at the ends of pin means 112 and hold the assemblage of sleeves 110, roller members 116 and second sleeve member 114 in a loose fit so that each of sleeve 110, second sleeve member 114 and roller member 116 may rotate freely on the pin means 112. The end caps 122, for example, are threaded onto the pin means 112. Alternatively, simple cotter-type pins (not shown) may be inserted through small holes (not shown) at the ends of pin means 112.

(Resistance linking means) Disposed between the lever arm 30 and the resistance means 90 are linking means 130. As best illustrated in FIGS. 3 and 4, the linking means 130, for example, includes a chain 132 operably associated with a guide means 134, which is here shown as a sprocket 135. Chain 132 has a first end 136 and a second end 140. The first end 136 is connected to the second sleeve member 114 through, for example, a master link 138. The second end 140 is connected to the lever arm 30 by a shaped pin 142 and receiving bracket 146 assembly. The shaped pin 142 is configured (i.e., shaped) to adjustably engage the receiving bracket 146. The second end 140 of the chain 132 is connected to the shaped pin 142 by a master link 144. Shaped pin 142 is secured to receiving bracket 146 through bracket tabs 148 that conform with cut-out portions 150 of the shaped pin 142. The receiving bracket 146 is pivotally connected to the lever arm 30 through a pin means 152.

The pin means 152 is preferably selectively connectable to the lever arm 30 by insertion through one of a second plurality of spaced apart apertures 33 that are disposed along the length 45 of lever arm 30. The bracket tabs 148 and the cut-out portions 150 are spaced to permit the shaped pin 142 to engage the receiving bracket 146 at different locations so that the overall length of the linking means 130 (i.e., the overall length between the point of attachment at the resistance means and the point of attachment at the lever arm) may be adjusted depending on which of said second plurality of spaced apart apertures 33 is selected for connection.

Figure 10:
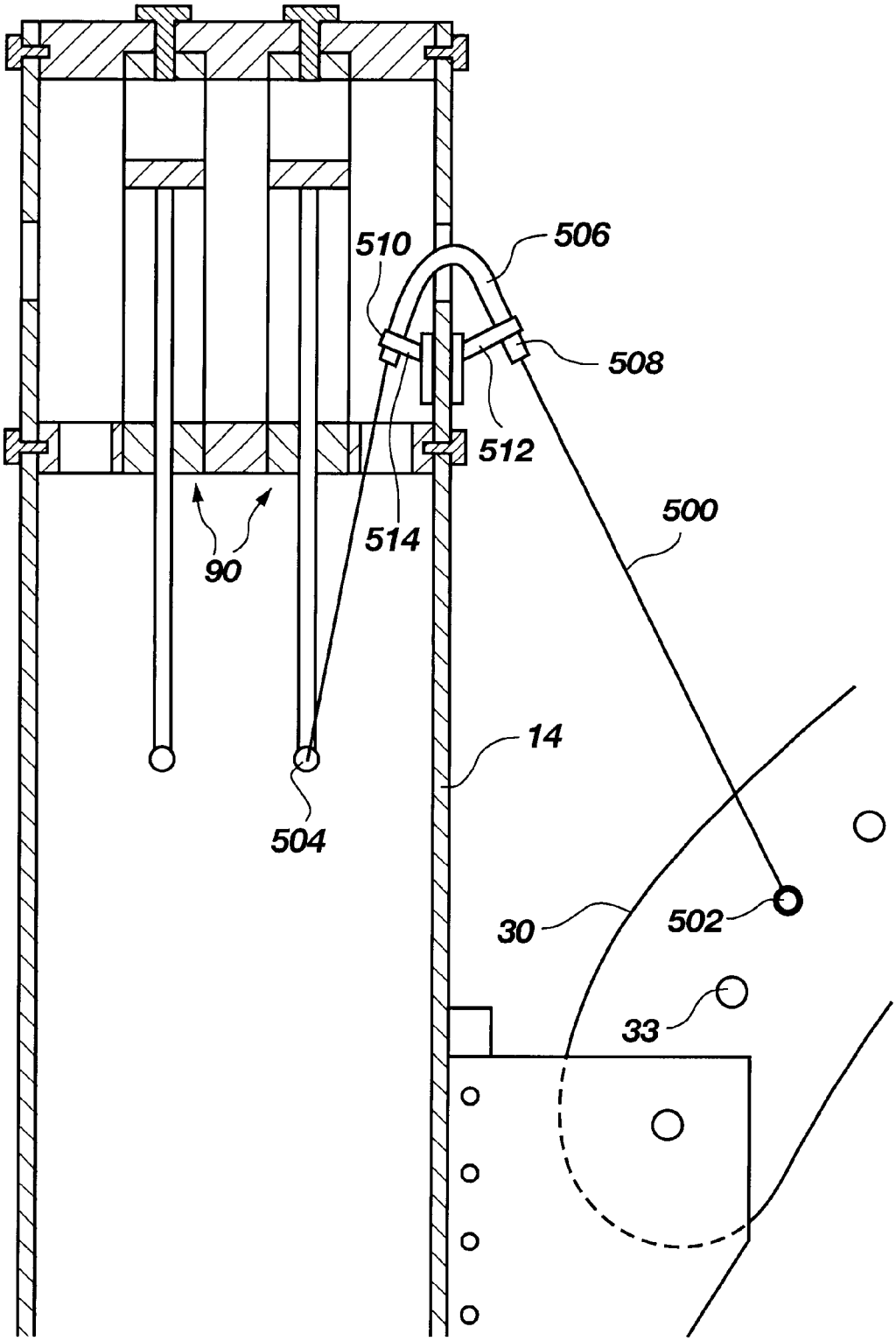
FIG. 10 is a view of an alternative embodiment of the connection means between the resistance means and the lever arm.

Chain 132 is preferably employed with the exercise machine disclosed herein because it is reliable and durable and less likely to stretch appreciably during the performance of exercise. Nevertheless, it should be appreciated that other means, such as a rope, for example, may be substituted in place of the chain 132. A still further alternative embodiment has a cable and guide means, as illustrated in FIG. 10, for connecting the lever arm 30 and the resistance means 90. As illustrated in FIG. 10, a cable 500 has a first end 502 connected to the lever arm 30 and a second end 504 connected to resistance means 90. The cable 500 is slidably disposed within the cable housing 506, which itself has first and second ends 508, 510 secured to the upright member 14 in a fashion that directs first and second ends 502, 504 to the lever arm 30 and the resistance means 90, respectively. As illustrated, securing clamps 512, 514 may be used for fastening the cable housing 506 to the upright member 14, although other suitable means may be employed. The securing clamps 512, 514 may themselves be secured to the upright member 14 by any suitable means, such as, for example, by welding. Means to selectively attach the first and second ends 502, 504 to the lever arm 30 and the to resistance means 90, respectively, for example, may be the same as those employed with the chain 132 and the sprocket 135. That is, an adjustable shaped pin and receiving bracket assembly (not shown) may be used to connect the first end 502 to the lever arm 30 and a master link or similar connection means (not shown) may be used to connect the second end 504 to the resistance means.

(Guide means) As illustrated in FIGS. 3 and 4, a guide means 134 is disposed proximate the resistance means 90. The guide means 134 is positioned to guide the first and second ends 136, 140 of the linking means 130 toward the outer portion 108 of piston rod 96 and the lever arm 30, respectively. The first and second ends 136, 140 are connected to the resistance means 90 (e.g., through piston rod 96) and the lever arm 30 as discussed above. An aperture 136 is preferably positioned through the side of the upright member 14 proximate the upper end 26. Mounting brackets 138 are welded or bolted at opposing sides of the aperture 136 for mounting the guide means 134 thereon. The guide means 134 is preferably a sprocket 135 sized to mate with the chain 132, and is mounted to the brackets 138 by a pin 141. Sealed lubricant bearings may be used in conjunction with the sprocket 135 to reduce friction associated with rotation of the sprocket 135 on the pin 141. As mentioned above, the cable 500 and the cable housing 506 may be substituted for the chain 132 and the sprocket 135, respectively. Similarly, a rope and pulley combination (not shown) may also be used.

Figure 11:
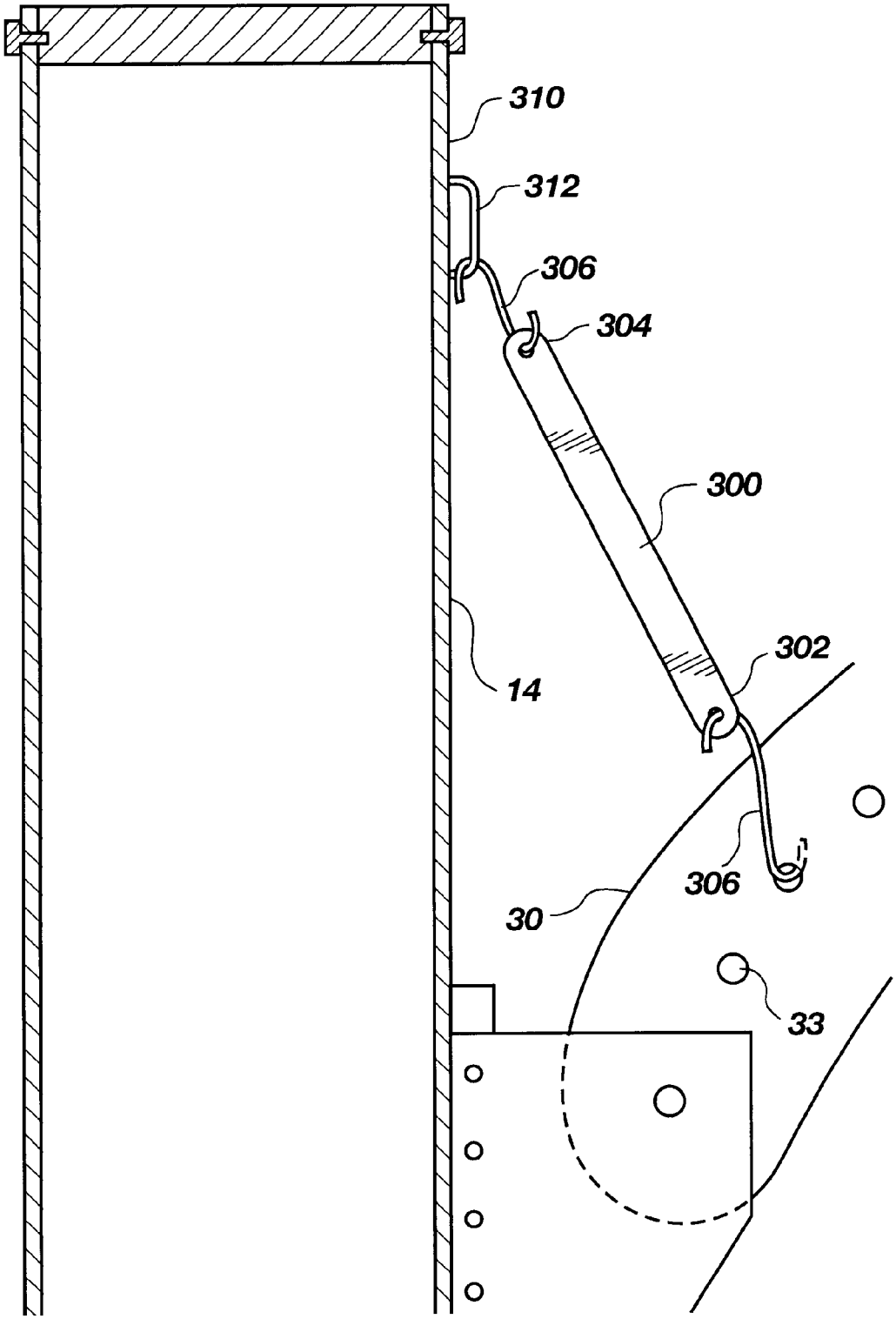
FIG. 11 is a view of an alternative embodiment of the resistance means.

(Alternative resistance structures) As stated above, it should be appreciated that various alternative configurations for resistance means 90 may be employed with the exercise machine of FIG. 1. For example, FIG. 11 illustrates an alternative embodiment to the exercise machine of FIG. 1. Here, resistance means 90 includes an elastically deformable element 300 having a first end 302 connected to lever arm 30 and a second end 304 connected to an exterior surface 310 of upright member 14. S-shaped clips 306 provide means to connect element 300 to lever arm 30 and to upright member 14. As illustrated, a clip connecting means 312 may be secured to upright member 14 for connecting clip 306 to upright member 14. Clip connecting means 312 may itself be secured to upright member 14 by welding or by other suitable means. Alternatively, a small hole drilled in the upright member 14 may be used to secure the clip 306.

The elastically deformable element 300 may be, for example, a coil spring, a bungee cord or an elastic band, such as a length of surgical tubing. Alternatively, a combination of the foregoing examples of deformable elements may be used in tandem, such as, for example, a coil spring together with an elastic band. A still further alternative substitutes an hydraulic or gas cylinder in place of deformable element 300, or incorporates the same along with deformable element 300.

Figure 12:
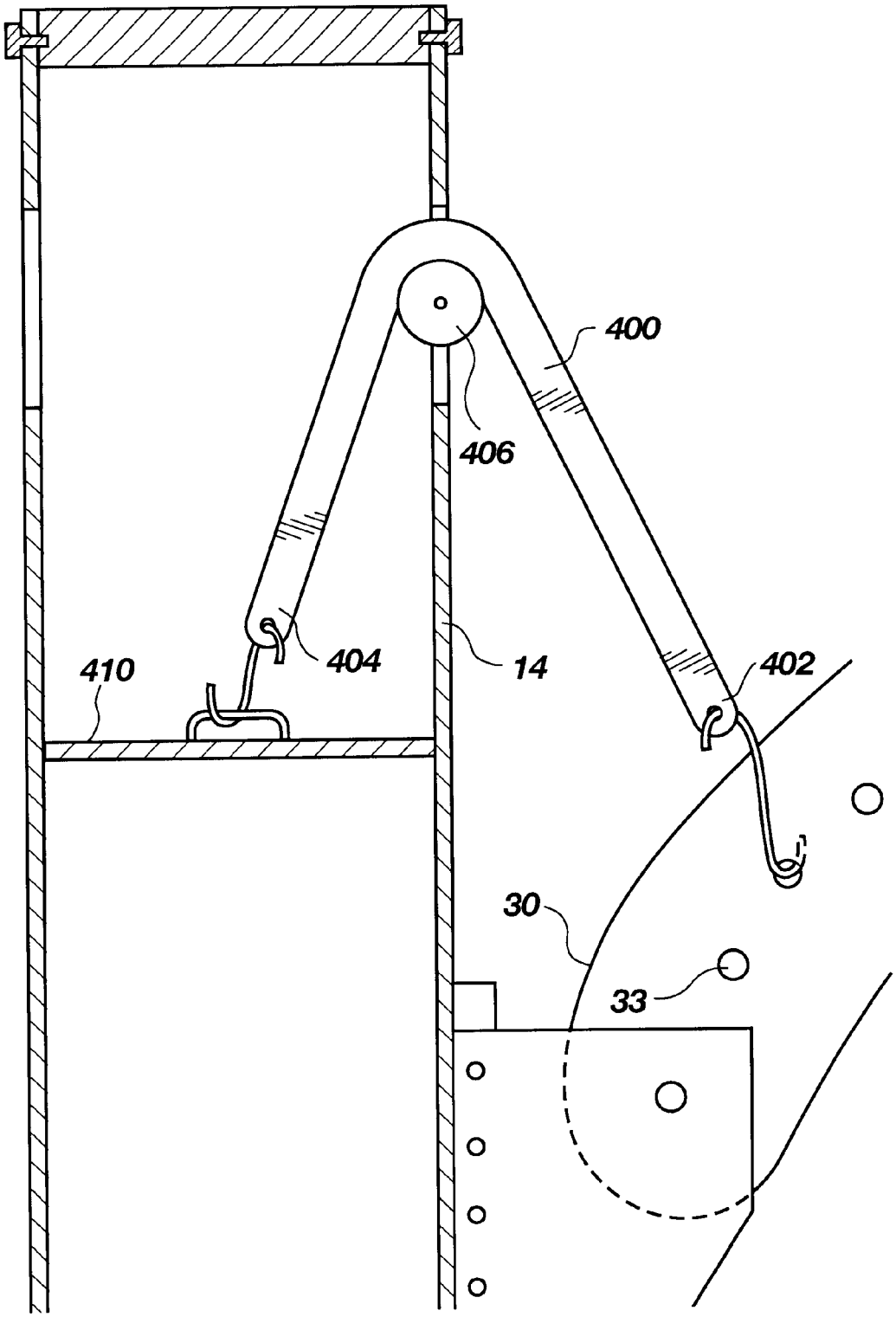
FIG. 12 is a view of an alternative embodiment of the resistance means.

Another alternative is illustrated in FIG. 12. Here, the resistance means 90 includes an elastically deformable element 400 having a first end 402 connected to lever arm 30 and a second end 404 connected to an interior surface 410 of upright member 14. Depending on the specific configuration and on design preference, such an arrangement may employ a guide means 406 for guiding first and second ends 402, 404 to their respective connection points on lever arm 30 and upright member 14 as illustrated. Guide means 406 may be, for example, a pulley means attached to upright member 14 in a manner similar to that previously discussed for sprocket 135. Alternatively, guide means 406 may take the form of a block (not shown) having an elongate groove formed therein to receive elastic element 400.

Another alternative (not illustrated) employs a volute-type spring mounted, for example, proximate support plates 34. The inner end of the spring would be fixedly connected to support plates 34 and the outer end of the spring would be connected to the lever arm 30. So configured, the center of the volute spiral is essentially coaxial with pivot means 32. Resistance to movement of lever arm 30 will thus arise through winding of the volute spring as lever arm 30 rotates from first position 40 toward second position 42.

Figure 5:
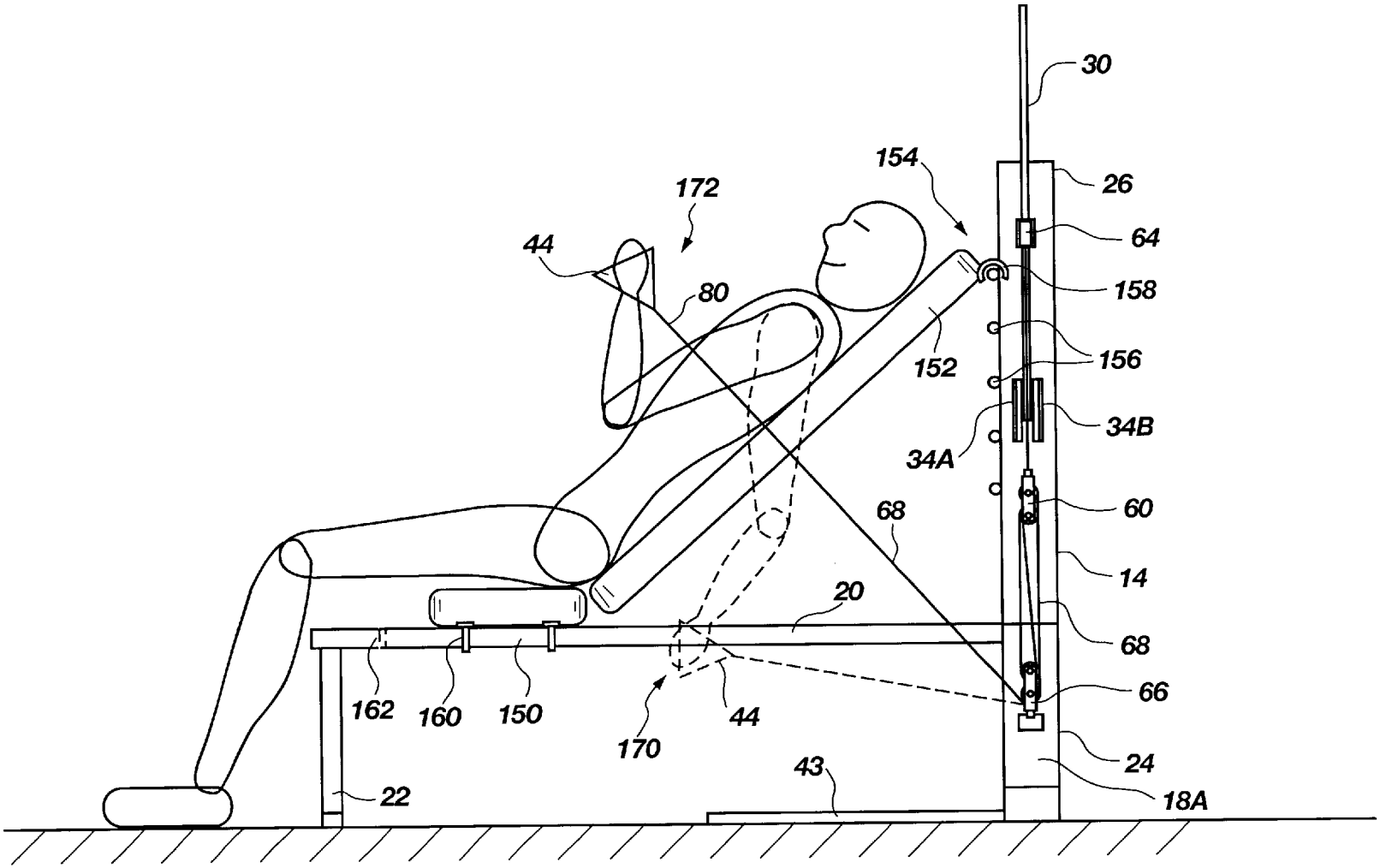
FIG. 5 is a view of a user performing biceps-curl type exercises using a preferred embodiment of the present invention.

(Bench) Referring now to FIG. 5, the exercise machine of FIG. 1 also includes a seat means 150 positioned atop bench 20 and a back support means 152 for supporting the back of a user in the performance of various exercises using exercise machine 10. Back support means 152 are connected to upright member 14 using hook and rod means 154 as illustrated. For example, hook and rod means 154 has a plurality of rods 156 that are connected at selected locations to upright member 14. Rods 156 are connected to upright member 14 using any suitable means, such as by welding, for example. A pair of hooks 158, corresponding to rods 156, are connected to back support means 152, also using any suitable means for making the connection.

Seat means 150 is connected to the bench 20 in a fashion similar to the hook and rod means 154. Alternatively, and as illustrated in FIG. 5, seat means 150 are connected to bench 20 using pin means 160. Pin means 160 are connected to seat member 150 using any suitable means, and are spaced thereon in a configuration that permits mechanical association with a plurality of apertures 162 that are spaced along bench 20. The foregoing illustrates means whereby the seat means 150 and the back support means 152 are positionable in various configurations on exercise machine 10 to accommodate performance of various types of exercise.

(Biceps Curl) Operational embodiments of the exercise machine 10 are illustrated in FIGS. 5–9. Referring to FIG. 5, for example, a user is shown positioned on exercise machine 10 in a fashion that permits curling of biceps. As illustrated, the user performs the biceps curl by repetitively moving moveable element 44 from a first position 170 to a second position 172, and then back to said first position 170. When moveable element 44 is moved from first position 170 to second position 172, the line or rope 68 is pulled through the second block 66 which, in turn, causes the distance between the first block 60 and the second block 66 to be shortened by an amount consistent with the mechanical advantage produced by the block and tackle assembly 54. This, in turn, causes the lever arm 30 to rotate from the first position 40 toward the second position 42, which rotation is resisted by the resistance means 90 as discussed previously.

Figure 6:
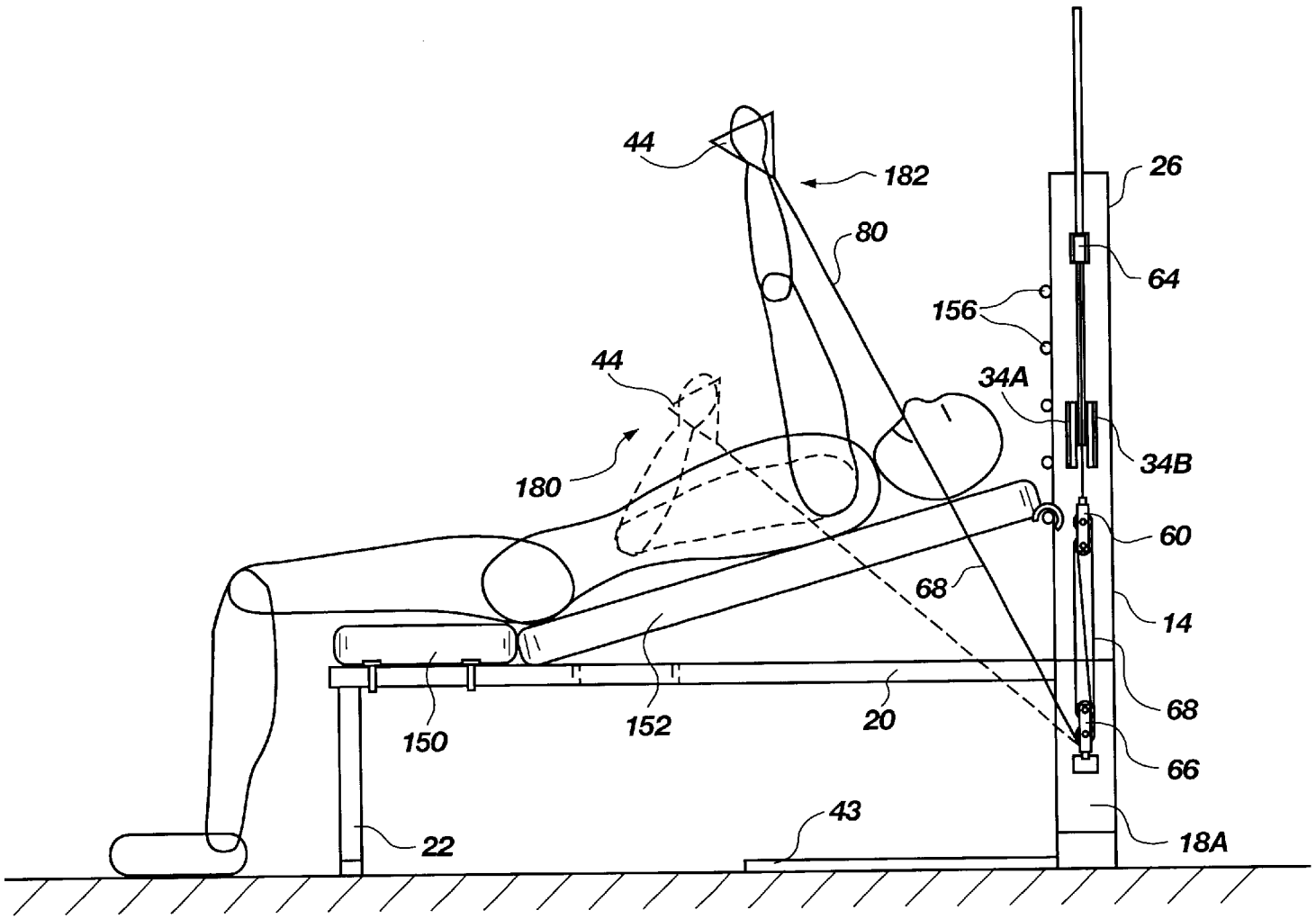
FIG. 6 is a view of a user performing bench-press type exercises using a preferred embodiment of the present invention.

(Bench Press) Referring now to FIG. 6, a user is shown positioned on exercise machine 10 in a fashion that permits bench press type exercise. As illustrated, the user performs the bench press like exercise by repetitively moving moveable element 44 from a first position 180 to a second position 182, and then back to said first position 180. As with the foregoing example, the movement of moveable element 44 from first position 180 to second position 182 results in rotation of lever arm 30 from its first position 40 toward its second position 42. Resistance to movement of moveable element 44 from first position 180 to second position 182 is thereby experienced by the user.

Figure 7:
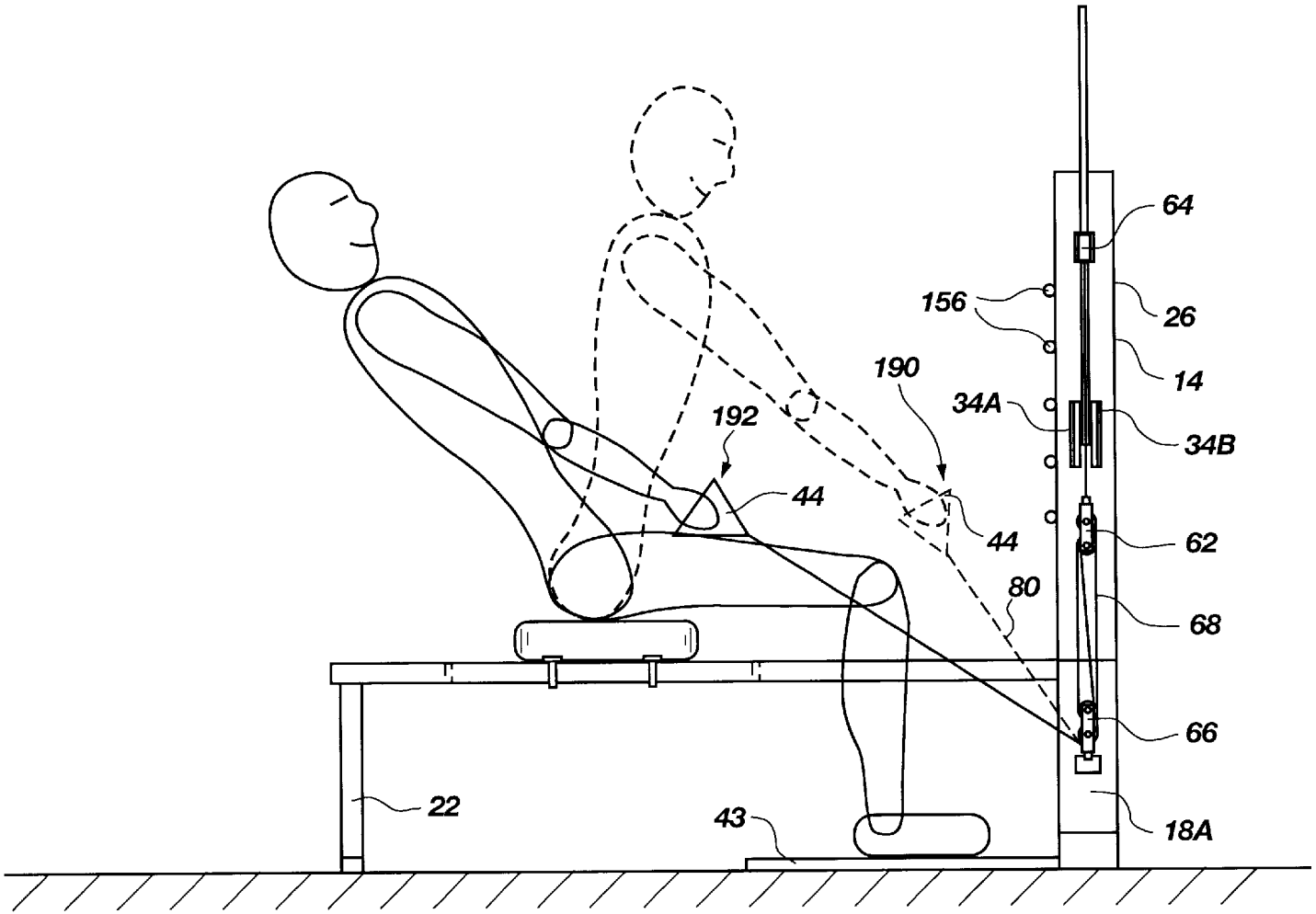
FIG. 7 is a view of a user performing rowing type exercises using a preferred embodiment of the present invention.

(Rowing) Referring now to FIG. 7, a user performing rowing type exercises is illustrated. For the rowing type exercise, back support means 152 is shown removed from exercise machine 10 as it is not needed. The rowing type exercise is performed by repetitively moving moveable element 44 from first position 190 to second position 192 as illustrated. As with both the foregoing examples, movement of the moveable element 44 from the first position toward the second position is met by resistance to rotation of the lever arm 30, which resistance is caused by the resistance means 90.

Figure 8:
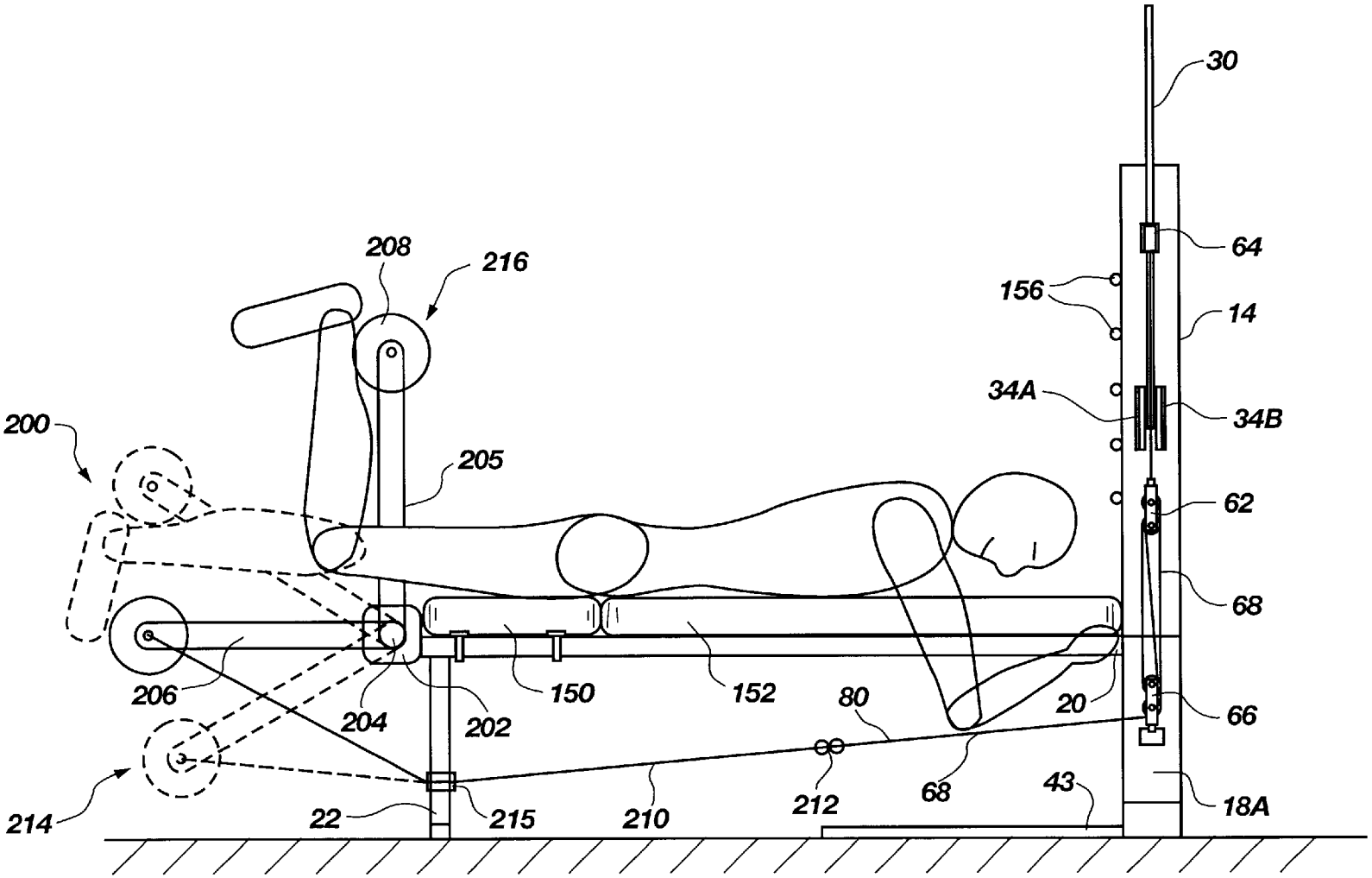
FIG. 8 is a view of a user performing leg-lift type exercises using a preferred embodiment of the present invention outfitted with leg-lift means.
Figure 9:
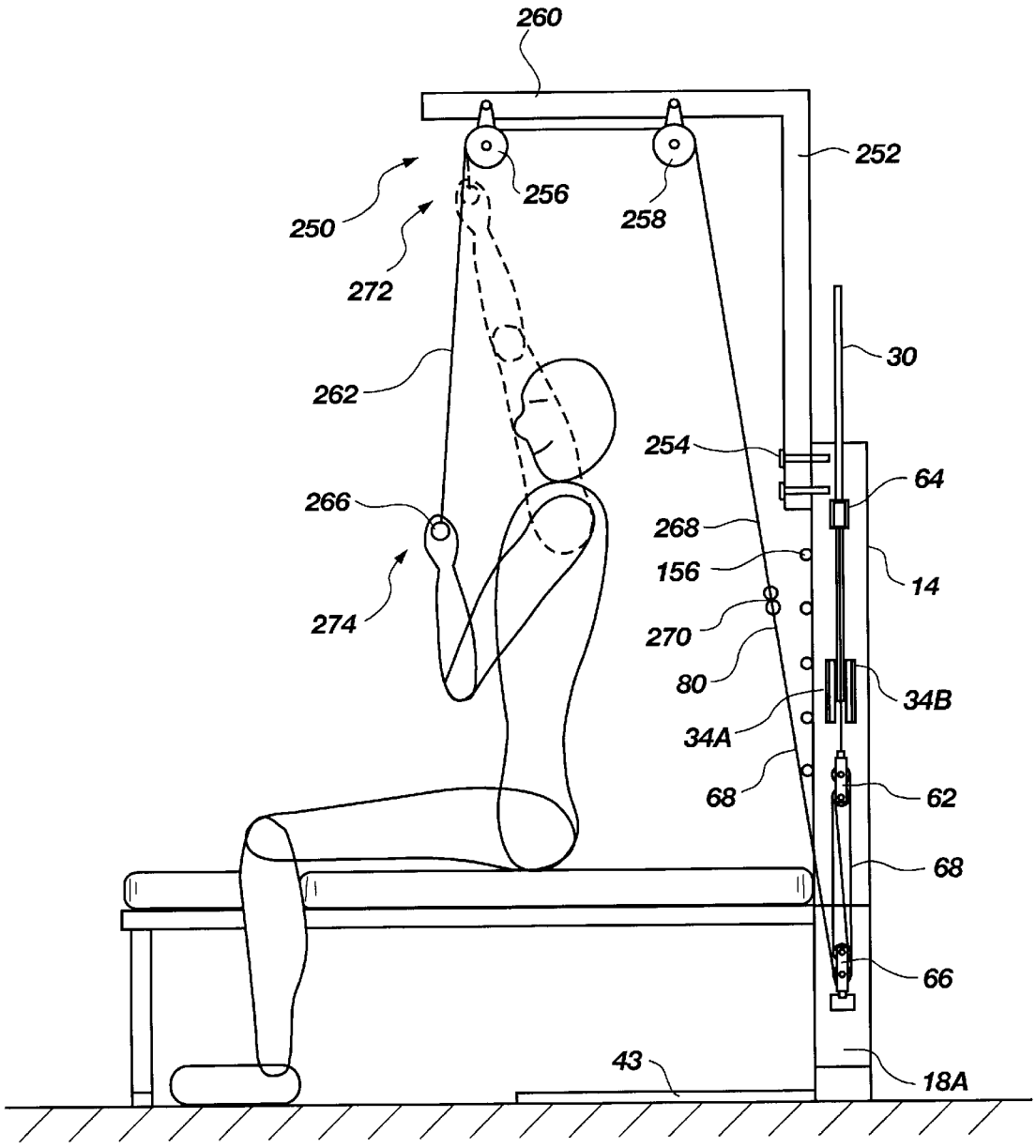
FIG. 9 is a view of a user performing lat-pull type exercises using a preferred embodiment of the present invention outfitted with a lat-pull bar.

(Leg Curl) Referring now to FIGS. 8 and 9, accessories configured for operable association with exercise machine 10 are illustrated. In FIG. 8, for example, a leg curl element 200 is shown connected to the exercise machine 10. Leg curl elements, such as leg curl element 200, are generally known in the art as evidenced by U.S. Pat. No. 4,183,520 (Chase), by U.S. Pat. No. 6,120,419 (Huang) and by U.S. Pat. No. 6,090,020 (Webber). In a preferred embodiment, as illustrated in FIG. 8, the leg curl element 200 is rotatably attached to the bench 20. The leg curl element 200 is preferably L-shaped and rotatably mounted in a bracket 202 by means of a pin 204 in a manner such that a first leg 205 lies substantially horizontal and a second leg 206 lies substantially vertical when the leg curl element 200 is in an at rest position (not shown). Rotatably mounted at the extremity of both the first leg 205 and the second leg 206 are tubular rolls 208. The leg curl element 200 is connected to the line or rope 68 through cable means 210. Cable means 210 has a first end connected to the line or rope 68 by connection means 212 and a second end connected to second leg 206. A cable guide means 215 is disposed on the rear support structure 22 for guiding the cable means 210 to the leg curl element 200 and to the line or rope 68. Movement of the leg curl element 200 from the first position 214 toward the second position 216 is met by resistance to rotation of the lever arm 30 from the first position 40 toward the second position 42, which resistance is caused by the resistance means 90. It is noted that the user of the exercise machine 10 may use leg curl element 200 in a seated position (not shown) as an alternative to the prone position shown in FIG. 8.

(Lat Pull) Referring now to FIG. 9, a lat pull down assembly 250 is shown connected to exercise machine 10. Lat pull down assemblies, such as lat pull down means 250, are also generally known in the art as evidenced by U.S. Pat. No. 5,487,714 (Ferrari). In a preferred embodiment, as illustrated in FIG. 9, the lat pull down assembly 250 includes an L-shaped member 252 secured to the upright member 14 by any suitable means, such as by bolts 254. First and second guide means, 256 and 258, are attached to a first portion 260 of the L-shaped member 252. Trained through the first and second guide means 256, 258 is a cable means 262. Cable means 262 has a first end 264 connected to lat pull down element 266 and a second end 268 connected to the line or rope 68 through connection means 270. Movement of the lat pull down element 266 from first position 272 to second position 274 is met by resistance to rotation of the lever arm 30 from first position 40 to second position 42, which resistance is caused by the resistance means 90.

Finally, it is noted that the various types of exercises that can be performed using exercise machine 10, such as the bench press, leg curl and lat pull types discussed above, are several and, accordingly, express reference to those embodiments discussed herein is not intended to limit use of the exercise machine 10 to only those embodiments. Thus, while preferred embodiments of the invention have been illustrated and described, it is to be understood that those skilled in the art will see obvious variations that rely on the essential elements of the invention. Therefore, the foregoing description is not intended to limit the scope of the invention that is defined by the following set of claims.

What is claimed is:

1. An exercise machine, comprising:

a frame having a base for positioning on a support surface and an upright member attached to and extending upwardly from said base, said upright member having a lower end attached to said base and an upper end spaced from said lower end;

a lever arm having a length, a first end and a second end spaced from said first end along said length, said lever arm being rotatably connected to said upright member and operable between a first lever arm position and a second lever arm position;

resistance means for resisting movement of said lever arm from said first lever arm position toward said second lever arm position, said resistance means being mechanically associated with said upright member and operably linked to said lever arm;

resistance linking means for operably linking said resistance means to said lever arm, said resistance linking means having a first end connected to said lever arm and a second end connected to said resistance means;

purchase means for providing a mechanical advantage to the user when moving said lever arm from said first lever arm position toward said second lever arm position, said purchase means being mechanically associated with said frame and operably linked with said lever arm;

purchase linking means for operably linking said purchase means to said lever arm, said purchase linking means having a first end connected to said lever arm and a second end connected to said purchase means;

first positioning means for selectively positioning said first end of said resistance linking means along said length of said lever arm;

second positioning means for selectively positioning said first end of said purchase linking means along said length of said lever arm; and moveable element means for moving said lever arm from said first lever arm position toward said second lever arm position, said moveable element means being mechanically associated with said purchase means.

2. The exercise machine of claim 1, wherein said upright member has an interior portion formed therein and wherein said resistance means is disposed within said interior portion, said upright member further having an aperture disposed proximate said interior portion for accessing said resistance means.

3. The exercise machine of claim 2, further including a first guide means disposed proximate said aperture for guiding said first end of said resistance linking means toward said lever arm and for guiding said second end of said resistance linking means toward said resistance means.

4. The exercise machine of claim 3, wherein said first positioning means includes a first plurality of apertures spaced along said length of said lever arm and wherein said first end of said resistance linking means is selectively connected to one of said first plurality of apertures.

5. The exercise machine of claim 4, wherein said resistance linking means has a length and wherein said first end of said resistance linking means includes means for adjusting said length.

6. The exercise machine of claim 5, wherein said resistance means includes at least one gas cylinder of the type having an housing and a telescoping piston rod slidably disposed within said housing, said telescoping piston rod having a distal end connected to said second end of said resistance linking means and said housing being connected to said upright member.

7. The exercise machine of claim 6, wherein said guide means includes a sprocket rotatably connected to said upright member and wherein said resistance linking means includes a chain with at least a portion thereof reeved about at least a portion of said sprocket, said chain having a first end and a second end.

8. The exercise machine of claim 7, wherein said first end of said chain is connected to one of said first plurality of apertures by a shaped pin and receiving bracket assembly, said shaped pin having a first end connected to said first end of said chain and a second end configured for adjustable connection with said receiving bracket, said receiving bracket having a first end selectively connected to one of said first plurality of apertures and a second end configured to adjustably receive said second end of said shaped pin, said first end of said receiving bracket being selectively connected to one of said first plurality of apertures by a pin mechanism, said second end of said shaped pin and said second end of said receiving bracket being adjustably connected to one another.

9. The exercise machine of claim 3, wherein said purchase means is a block and tackle assembly having a first block and a second block interconnected to said first block by a line, said line having a distal end extending away from one of said first block and said second block and being connected to said moveable element, said block and tackle assembly being operable to move said lever arm from said first lever arm position toward said second lever arm position upon movement of said movable element from said first moveable element position toward said second moveable element position.

10. The exercise machine of claim 9, wherein said first block is connected to said lever arm by said purchase linking means and wherein said second block is connected to said frame.

11. The exercise machine of claim 10, wherein said purchase linking means includes a cable having a first end, a second end and a bight therein between, said first end being connected to said lever arm and said second end being connected to said first block.

12. The exercise machine of claim 11, further having a second guide means for operably contacting the bight of said cable and for displacing said bight upon movement of said lever arm, said second guide means being connected to said second positioning means.

13. The exercise machine of claim 12, wherein said second positioning means is a second plurality of apertures spaced along said length of said lever arm and wherein said second guide means is a pulley means, said pulley means being selectively connected to one of said second plurality of apertures.

14. The exercise machine of claim 3, further including a bench extending outwardly from said upright member with seating means positioned thereon for receiving a user in the performance of exercise, said bench having a support structure disposed thereunder for supporting said user, said exercise machine further including back support means for receiving the back of a user in the performance of exercise, said back support means having first connection means for selectively connecting said back support means to said upright member.

15. The exercise machine of claim 14, further including a leg curl assembly operably associated with said bench, and wherein said moveable element is a leg curl element.

16. The exercise machine of claim 13, wherein said first end of said cable is connected to said lever arm at a first connection point proximate said second end of said lever arm, wherein said second block is connected to said frame at a second connection point and wherein said first connection point, said second connection point and said second plurality of apertures lie essentially in a plane, and wherein said second plurality of apertures lie essentially on an elliptical path coplanar with said plane and wherein said first and second connection points lie essentially at the focal points defined by said elliptical path when said lever arm is in said first position.

17. An apparatus for use in the performance of exercise, comprising:

a frame having a base for positioning on a support surface and an upright member attached to and extending upwardly from said base, said upright member having a lower end attached to said base and an upper end spaced from said lower end, said upright member further having an interior portion formed therein and an aperture disposed proximate said interior portion;

a lever arm having a length, a first end and a second end spaced from said first end along said length, said lever arm being rotatably connected to said upright member and operable between a first lever arm position and a second lever arm position, said lever arm having a plurality of apertures spaced apart along said length;

a gas cylinder operably disposed within said interior portion for resisting movement of said lever arm from said first lever arm position toward said second lever arm position, said gas cylinder having a housing connected to said upright member and a telescoping piston rod slidably disposed within said housing, said telescoping piston rod having a distal end;

a chain having a first end selectively connected to one of said plurality of apertures, a second end connected to said distal end of said telescoping piston rod and a bight therein between;

a sprocket for operably contacting the bight of said chain, said sprocket being rotatably connected to said upright member proximate said aperture;

a block and tackle assembly for providing a mechanical advantage to the user when moving said lever arm from said first lever arm position toward said second lever arm position, said block and tackle assembly including a first block and a second block interconnected to said first block by a line having a distal end, said second block being connected to said frame;

a cable having a first end, a second end and a bight therein between, said first end being connected to said lever arm and said second end being connected to said first block;

a pulley for operably contacting the bight of said cable and for displacing said bight upon movement of said lever arm, said pulley being selectively connected to one of said plurality of apertures;

a bench extending outwardly from said upright member with seating means positioned thereon for receiving a user in the performance of exercise, said bench having a support structure disposed thereunder for supporting said user; and moveable element means for moving said lever arm from said first lever arm position toward said second lever arm position, said moveable element means being connected to said distal end of said line.

18. The exercise machine of claim 17, wherein said first end of said cable is connected to said lever arm at a first connection point proximate said second end of said lever arm, wherein said second block is connected to said frame at a second connection point and wherein said first connection point, said second connection point and said plurality of apertures lie essentially in a plane, and wherein said plurality of apertures lie essentially on an elliptical arc coplanar with said plane and wherein said first and second connection points lie essentially at the focal points of an ellipse defined by said elliptical arc when said lever arm is in said first position.

19. An apparatus for use in the performance of exercise, comprising:

a frame having a base for positioning on a support surface and an upright member attached to and extending upwardly from said base, said upright member having a lower end attached to said base and an upper end spaced from said lower end, said upright member having a first side and a second side opposite said first side, said upright member further having an interior portion formed therein and first and second apertures disposed proximate said interior portion, said first aperture being positioned on said first side of said upright member and said second aperture being positioned on said second side of said upright member;

a first lever arm having a length, a first end and a second end spaced from said first end along said length, said lever arm being rotatably connected to said first side of said upright member and operable between a first lever arm position and a second lever arm position, said lever arm having a plurality of apertures spaced along said length;

a second lever arm having a length, a first end and a second end spaced from said first end along said length, said lever arm being rotatably connected to said second side of said upright member and operable between a first lever arm position and a second lever arm position, said lever arm having a plurality of apertures spaced along said length;

a first gas cylinder operably disposed within said interior portion for resisting movement of said first lever arm, said first gas cylinder having a housing connected to said upright member and a telescoping piston rod slidably disposed within said housing, said telescoping piston rod having a distal end in mechanical association with said first lever arm;

a second gas cylinder operably disposed within said interior portion for resisting movement of said second lever, said second gas cylinder having a housing connected to said upright member and a telescoping piston rod slidably disposed within said housing, said telescoping piston rod having a distal end in mechanical association with said second lever arm;

a first chain having a first end selectively connected to one of said plurality of apertures on said first lever arm and a second end connected to said distal end of said telescoping piston rod of said first gas cylinder;

a second chain having a first end selectively connected to one of said plurality of apertures on said second lever arm and a second end connected to said distal end of said telescoping piston rod of said second gas cylinder;

a first sprocket for operably contacting said first chain, said sprocket being rotatably connected to said upright member proximate said first aperture;

a second sprocket for operably contacting said second chain, said sprocket being rotatably connected to said upright member proximate said second aperture;

a first block and tackle assembly for providing a mechanical advantage to the user when moving said first lever arm, said first block and tackle assembly including a first block and a second block interconnected to said first block by a line having a distal end, said second block being connected to said frame;

a second block and tackle assembly for providing a mechanical advantage to the user when moving said second lever arm, said first block and tackle assembly including a first block and a second block interconnected to said first block by a line having a distal end, said second block being connected to said frame;

a first cable having a first end, a second end and a bight therein between, said first end being connected to said first lever arm and said second end being connected to said first block of said first block and tackle assembly;

a second cable having a first end, a second end and a bight therein between, said first end being connected to said second lever arm and said second end being connected to said first block of said second block and tackle assembly;

a first pulley for operably contacting the bight of said first cable and for displacing said bight upon movement of said first lever arm, said first pulley being selectively connected to one of said plurality of apertures on said first lever arm;

a second pulley for operably contacting the bight of said second cable and for displacing said bight upon movement of said second lever arm, said second pulley being selectively connected to one of said plurality of apertures on said second lever arm;

a bench extending outwardly from said upright member with seating means positioned thereon for receiving a user in the performance of exercise, said bench having a support structure disposed thereunder for supporting said user; and moveable element means for moving said first lever arm from said first lever arm position toward said second lever arm position and for moving said second lever arm from said first lever arm position toward said second lever arm position, said moveable element means being connected to said distal end of said first line and to said distal end of said second line.

* * * * *